US011825903B2

(12) United States Patent
Sakaguchi et al.

(10) Patent No.: US 11,825,903 B2
(45) Date of Patent: Nov. 28, 2023

(54) SHOE SOLE AND SHOE

(71) Applicant: ASICS Corporation, Kobe (JP)

(72) Inventors: Masanori Sakaguchi, Kobe (JP); Seigo Nakaya, Kobe (JP); Kenta Moriyasu, Kobe (JP); Shingo Takashima, Kobe (JP); Yuya Kozuka, Kobe (JP); Tomoki Ishizashi, Kobe (JP); Akihisa Sugifune, Kobe (JP); Hiroaki Nishimura, Kobe (JP); Takayuki Kogure, Kobe (JP)

(73) Assignee: ASICS CORPORATION, Hyogo (JP)

( * ) Notice: Subject to any disclaimer, the term of this patent is extended or adjusted under 35 U.S.C. 154(b) by 239 days.

(21) Appl. No.: 17/255,974

(22) PCT Filed: Dec. 28, 2018

(86) PCT No.: PCT/JP2018/048618

§ 371 (c)(1),
(2) Date: Dec. 23, 2020

(87) PCT Pub. No.: WO2020/136916

PCT Pub. Date: Jul. 2, 2020

(65) Prior Publication Data

US 2021/0267306 A1 Sep. 2, 2021

(51) Int. Cl.

| | |
|---|---|
| ***A43B 13/14*** | (2006.01) |
| ***A43B 13/12*** | (2006.01) |
| ***A43B 7/145*** | (2022.01) |

(52) U.S. Cl.

CPC ..... *A43B 13/14* (2013.01); *A43B 7/145* (2013.01); *A43B 13/127* (2013.01); *A43B 13/145* (2013.01)

(58) Field of Classification Search

None

See application file for complete search history.

(56) References Cited

U.S. PATENT DOCUMENTS

| | | | | |
|---|---|---|---|---|
| 7,513,065 | B2 | 4/2009 | Kita et al. | |
| 7,877,897 | B2 * | 2/2011 | Teteriatnikov ..... | A43B 13/145 36/31 |

(Continued)

FOREIGN PATENT DOCUMENTS

| | | | |
|---|---|---|---|
| CN | 101090649 | A | 12/2007 |
| CN | 104684431 | A | 6/2015 |

(Continued)

OTHER PUBLICATIONS

International Search Report issued in corresponding International Patent Application No. PCT/JP2018/048618, dated Mar. 5, 2019, with English translation.

(Continued)

*Primary Examiner* — Jila M Mohandesi

(74) *Attorney, Agent, or Firm* — McDermott Will & Emery LLP

(57) ABSTRACT

A shoe sole includes a rear bottom surface part and a toe portion. The rear bottom surface part is formed to extend from a rearfoot portion to a midfoot portion and, when the shoe sole is placed on a flat virtual surface, the rear bottom surface part is in contact with the virtual surface. A height of the toe portion from the virtual surface is set to 170% or greater and 250% or less with respect to a thickness dimension in the rear bottom surface part.

16 Claims, 13 Drawing Sheets

(56) References Cited

U.S. PATENT DOCUMENTS

| | | | | |
|---|---|---|---|---|
| 8,079,159 | B1 * | 12/2011 | Rosa | A43B 7/142 36/31 |
| 9,289,028 | B1 * | 3/2016 | Anderson | A43B 7/148 |
| 2006/0137227 | A1 | 6/2006 | Kita et al. | |
| 2011/0035960 | A1 * | 2/2011 | Werremeyer | A43B 13/12 36/28 |
| 2011/0072690 | A1 * | 3/2011 | Teteriatnikov | A43B 13/188 36/30 R |
| 2011/0154693 | A1 * | 6/2011 | Oberschneider | A43B 17/08 36/25 R |
| 2011/0185593 | A1 * | 8/2011 | Ramos | A43B 13/145 36/103 |
| 2014/0047740 | A1 * | 2/2014 | Tucker | A43B 13/223 36/83 |
| 2014/0250723 | A1 * | 9/2014 | Kohatsu | A43B 13/141 36/28 |
| 2016/0345668 | A1 * | 12/2016 | Dyer | A43B 13/186 |
| 2017/0035143 | A1 | 2/2017 | Sato et al. | |
| 2017/0095033 | A1 * | 4/2017 | Farina | A43B 13/145 |
| 2018/0146744 | A1 * | 5/2018 | Guest | A43B 13/145 |
| 2021/0085025 | A1 * | 3/2021 | Geis | A43B 13/14 |

FOREIGN PATENT DOCUMENTS

| | | | |
|---|---|---|---|
| JP | H10155508 | A | 6/1998 |
| JP | 4087882 | B2 | 5/2008 |
| JP | 2013-046667 | A | 3/2013 |
| JP | 2014-210155 | A | 11/2014 |
| JP | 2015-524739 | A | 8/2015 |
| JP | 2018-529461 | A | 10/2018 |

OTHER PUBLICATIONS

Chinese Office Action issued in corresponding Chinese Patent Application No. 201880094514.4, dated Apr. 12, 2022, with English translation.

Brazil Office Action issued for corresponding Brazil Patent Application No. BR112021000401-7, dated Jun. 14, 2022, with English translation of the preliminary Office Action.

* cited by examiner

1

SHOE SOLE AND SHOE

CROSS-REFERENCE OF RELATED APPLICATION

This application is the U.S. National Phase under 35 U.S.C. § 371 of International Patent Application No. PCT/JP2018/048618, filed on Dec. 28, 2018, the entire disclosure of which Application is incorporated by reference herein.

TECHNICAL FIELD

The present invention relates to shoe soles and shoes used for sports or the like.

BACKGROUND ART

Shoes used for sports or the like are desired to follow the motion of foot portions of the wearer and firmly support the feet during walking, running, or exercising, for example, and also to reduce fatigue of the feet.

For example, Patent Literature 1 discloses a shoe sole that includes a curved portion extending between an anterior-most point disposed in a forefoot region and a posterior-most point disposed closer to a heel region than the anterior-most point. The curved portion has a constant radius of curvature in a region from the anterior-most point to a metatarsophalangeal point (MP point).

RELATED ART DOCUMENT

Patent Literture

Patent Literature 1: Japanese Translation of PCT International Application Publication No. 2018-529461

SUMMARY OF INVENTION

Problem to be Solved by the Invention

In Patent Literature 1, the shoe sole of the forefoot region is curved to reduce the length of the lever arm about the ankle, thereby reducing the strain at the ankle joint; however, dissipation of energy caused by the motion of the ankle joint itself is not considered. With regard to the dissipation of energy caused by the motion of the ankle joint itself, the inventors have obtained the following findings.

The range of motion of the ankle joint angle in the sagittal plane varies according to the relative height positions of the heel and the toe. For example, in a situation where a person walks or runs forward, when the heights of the heel and the toe are almost the same, the motion of the ankle joint accompanying the forward shift of the center of gravity becomes larger before rotational motion of the foot starts, so that the strain due to the dissipation of energy caused by the motion of the ankle joint itself is increased. In the shoe sole described in Patent Literature 1, the thickness of the shoe sole in the heel portion, i.e., the height of the heel portion, is almost the same as the height of the toe, as illustrated in FIG. 3 of Patent Literature 1 for example, and the ankle joint angle in the sagittal plane is not considered.

The present invention has been made in view of such an issue, and a purpose thereof is to provide a shoe sole and a shoe that can restrain the motion of the ankle joint and reduce the energy generated at the ankle joint.

Means to Solve the Problem

An aspect of the present invention relates to a shoe sole. The shoe sole includes: a rear bottom surface part formed to extend from a rearfoot portion to a midfoot portion and to be, when the shoe sole is placed on a virtual surface as a flat surface, in contact with the virtual surface; and a toe portion of which a height from the virtual surface is set to 170% or greater and 250% or less with respect to a thickness dimension in the rear bottom surface part.

Another aspect of the present invention relates to a shoe. The shoe includes the shoe sole as described above, and an upper disposed on the shoe sole.

Optional combinations of the aforementioned constituting elements, and implementation of the present invention, including the constituting elements and expressions, in the form of methods or apparatuses may also be practiced as additional modes of the present invention.

Effect of the Invention

The present invention can restrain the motion of the ankle joint and reduce the energy generated at the ankle joint.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

MODE FOR CARRYING OUT THE INVENTION

Figure 1:
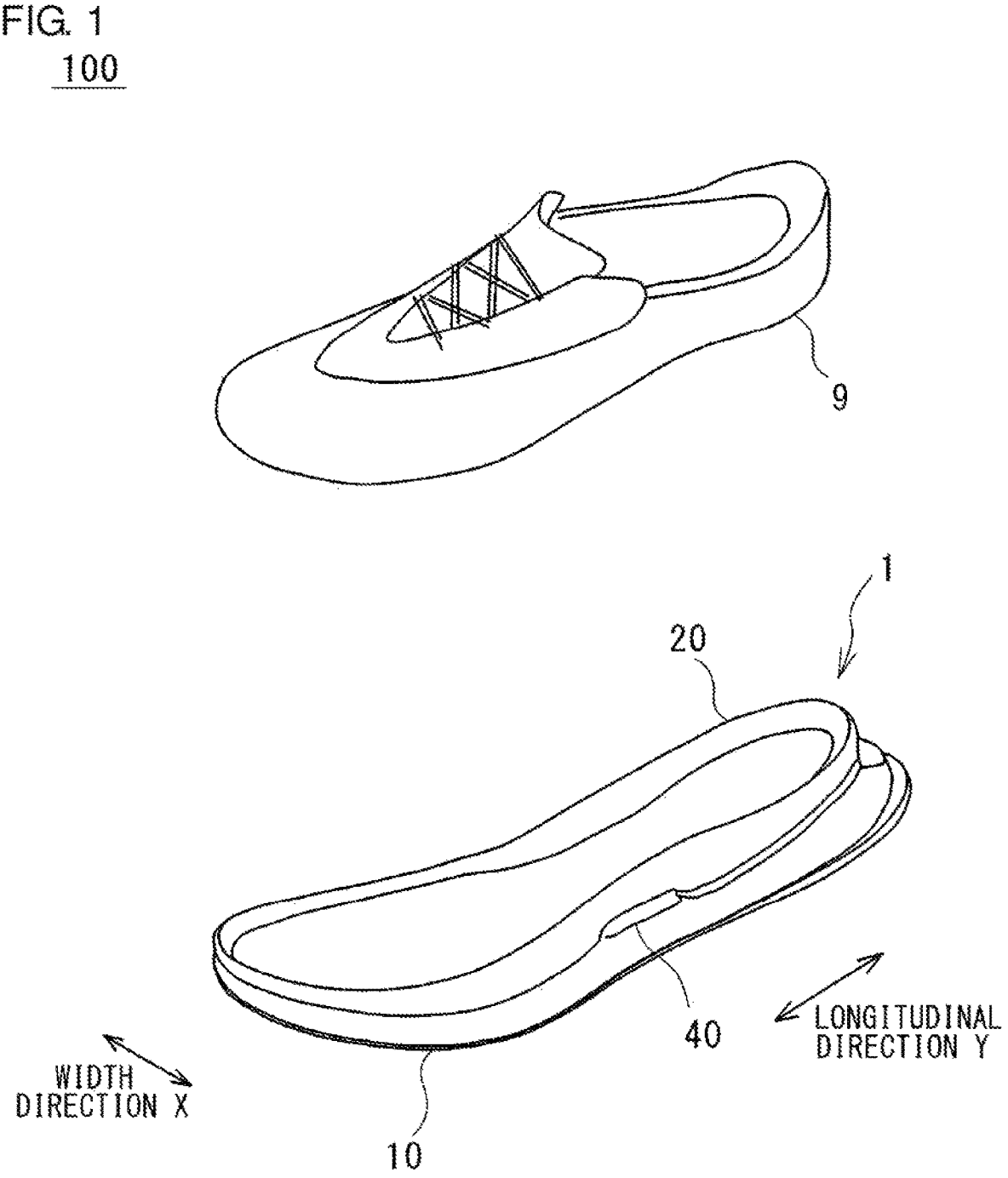
FIG. 1 is an exploded perspective view that illustrates an external view of a shoe according to a first embodiment.

In the following, the present invention will be described based on preferred embodiments with reference to FIGS. 1 through 14. Like reference characters denote like or corresponding constituting elements and members in each drawing, and repetitive description will be omitted as appropriate. Also, the dimensions of a member may be appropriately enlarged or reduced in each drawing in order to facilitate understanding. Further, in each drawing, part of a member less relevant in describing embodiments may be omitted.

First Embodiment

FIG. 1 is an exploded perspective view that illustrates an external view of a shoe 100 according to a first embodiment. The shoe 100 includes an upper 9 and a shoe sole 1. The upper 9 is bonded to or sewed onto a circumferential edge part of the shoe sole 1 to cover the upper side of a foot. The shoe sole 1 includes an outer sole 10 and a midsole 20, for example, and is configured by laminating the midsole 20 on the outer sole 10 and further laminating an insole or the like thereon, which is not illustrated. In the midsole 20, a through hole part 40 penetrating in a width direction is formed.

Figure 2:
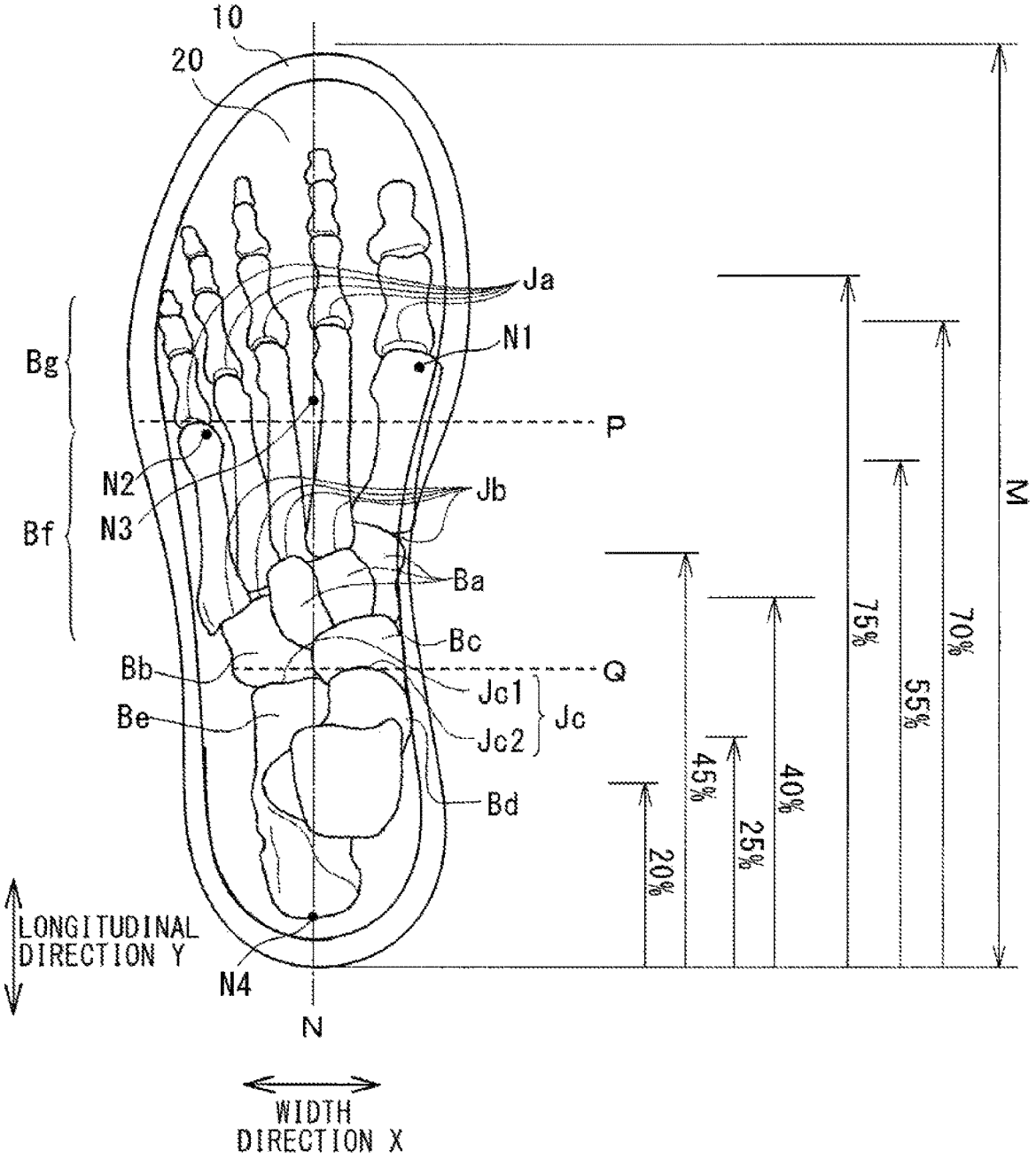
FIG. 2 is a schematic diagram in which a skeleton model of a human foot is superimposed upon a plan view of a shoe sole.

FIG. 2 is a schematic diagram in which a skeleton model of a human foot is superimposed upon a plan view of the shoe sole 1. A human foot is mainly constituted by cuneiform bones Ba, a cuboid bone Bb, a navicular bone Bc, a talus Bd, a calcaneus Be, metatarsal bones Bf, and phalanges Bg. Joints of a foot include MP joints Ja, Lisfranc joints Jb, and a Chopart's joint Jc. The Chopart's joint Jc includes a calcaneocuboid joint Jc1 formed by the cuboid bone Bb and the calcaneus Be, and a talocalcaneonavicular joint Jc2 formed by the navicular bone Bc and the talus Bd.

In the present invention, a center line N of a foot is represented by a straight line connecting a midpoint N3 between the center N1 of the thenar eminence and the center N2 of the hypothenar eminence, and the center N4 of the heel. For example, a longitudinal direction Y is in parallel with the center line N, and a width direction X is perpendicular to the center line N. A line P represents a straight line that extends along a width direction X, which is a direction perpendicular to the center line N, and that is assumed to pass through the heel-side end of the MP joints Ja. Also, a line Q represents a straight line that extends along a width direction X and that is assumed to pass through the toe-side end of the Chopart's joint Jc of the wearer. Hereinafter, a region from the line P to the toe is referred to as a forefoot portion, a region from the line P to the line Q is referred to as a midfoot portion, and a region from the line Q to the heel is referred to as a rearfoot portion. With regard to the relationship between the lines P, Q and the shoe 100, the line P is positioned within a range from 40% to 75% of the entire length M of the shoe 100 from the rear end on the heel side in a direction along the center line N, for example. More preferably, the line P is positioned within a range from 55% to 70% from the rear end. Also, the line Q is positioned within a range from 20% to 45% of the entire length M of the shoe 100 from the rear end on the heel side in a direction along the center line N. More preferably, the line Q is positioned within a range from 25% to 40% from the rear end.

Figure 3:
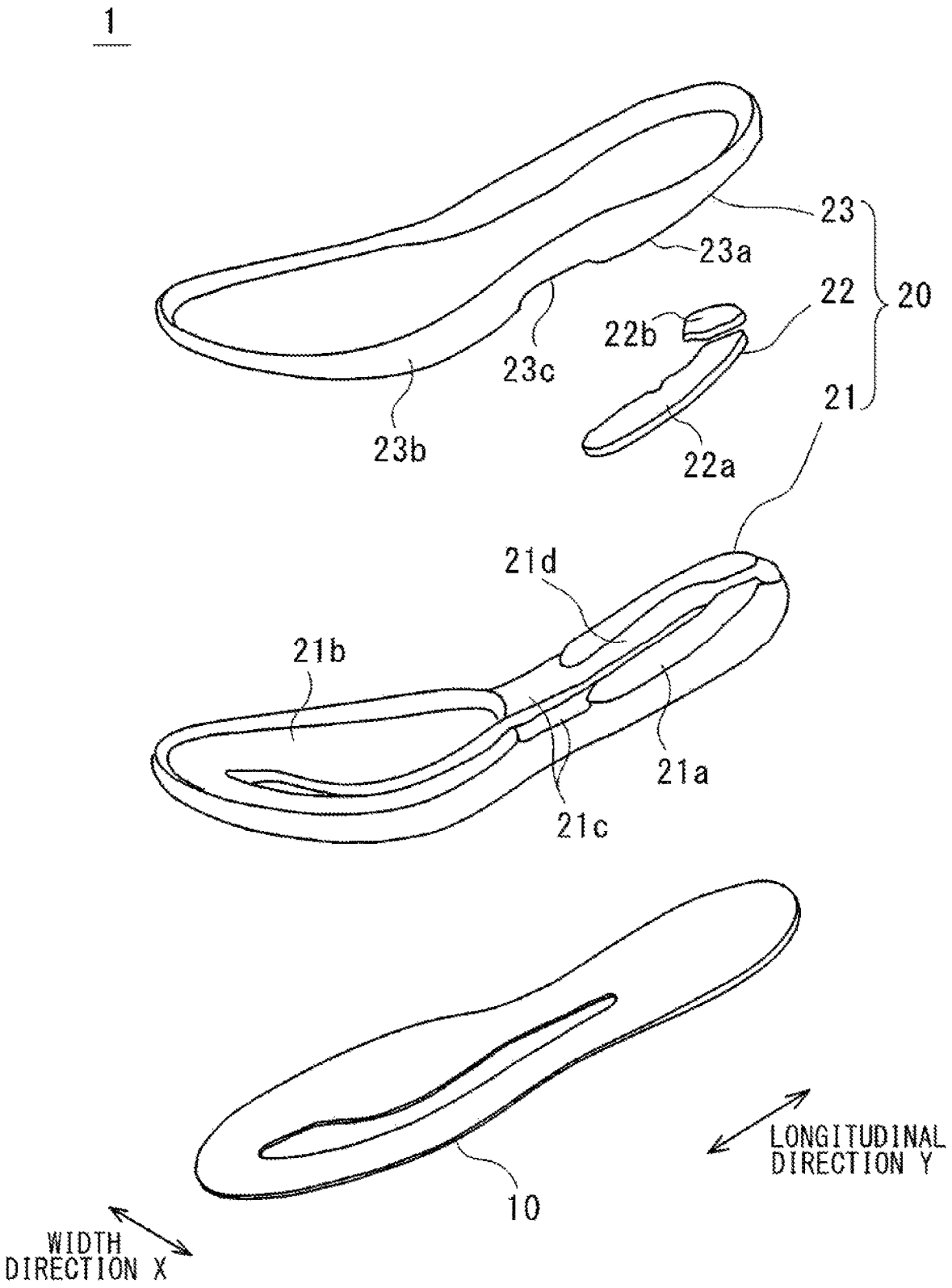
FIG. 3 is an exploded perspective view of the shoe sole.

FIG. 3 is an exploded perspective view of the shoe sole 1. The outer sole 10 includes a bottom surface portion, which comes into contact with a road surface, formed along the entire foot length in a longitudinal direction Y. The toe side is positioned higher than the heel side so that the motion of a foot from the landing to pushing off can be smoothly performed. The outer sole 10 is formed of a rubber material or the like, so as to absorb bumps and dips on a road surface and have abrasion resistance and durability.

The midsole 20 is disposed on the outer sole 10 and formed along the entire foot length in a longitudinal direction Y. The midsole 20 includes a lower midsole 21, an upper midsole 23, and a cushion member 22. In the lower midsole 21, a rearfoot part 21*a* and a forefoot part 21*b* are continuously formed, and, in the midfoot portion, a recess 21*c* is provided such as to hole the rearfoot part 21*a* downward. The recess 21*c* forms an inner surface on the bottom side of the through hole part 40 illustrated in FIG. 1, and an inner surface 23*c* on the upper side of the through hole part 40 is formed by the midfoot portion of the upper midsole 23. Also, a groove 21*d* is provided such as to extend in a longitudinal direction from the rearfoot portion to the midfoot portion of the lower midsole 21.

Figure 4A:
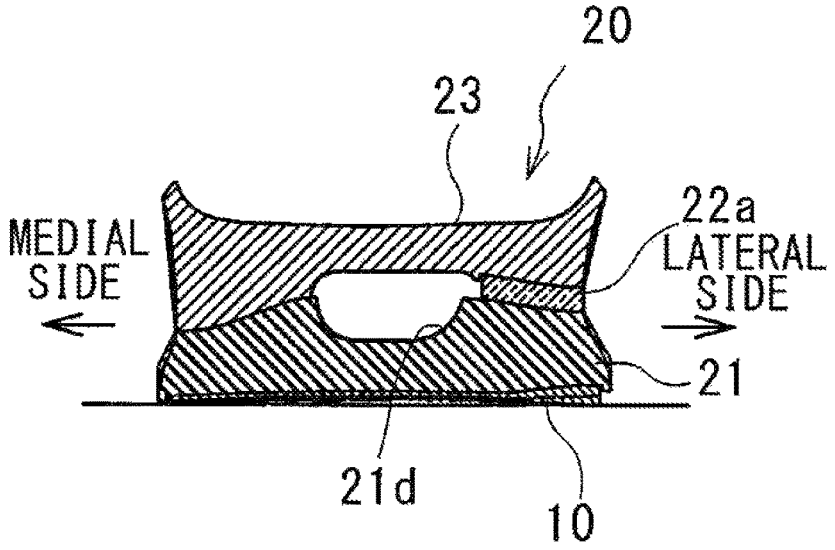
FIGS. 4A, 4B, 4C and 4D are sectional views of a heel portion, which each intersect a longitudinal direction.
Figure 4B:
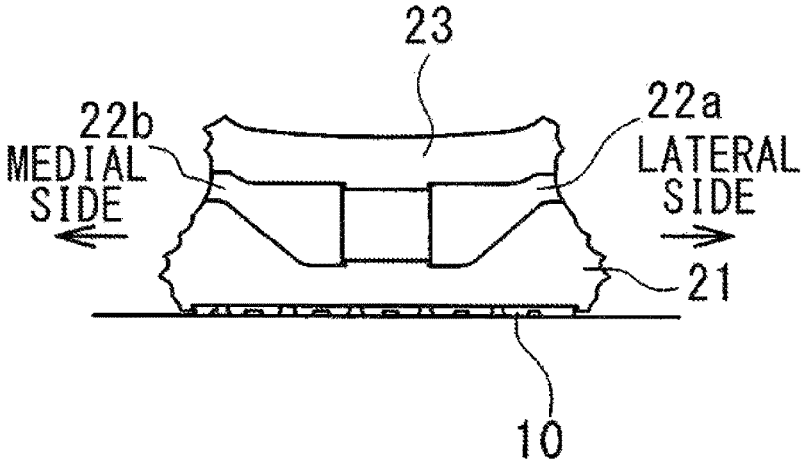
Figure 4C:
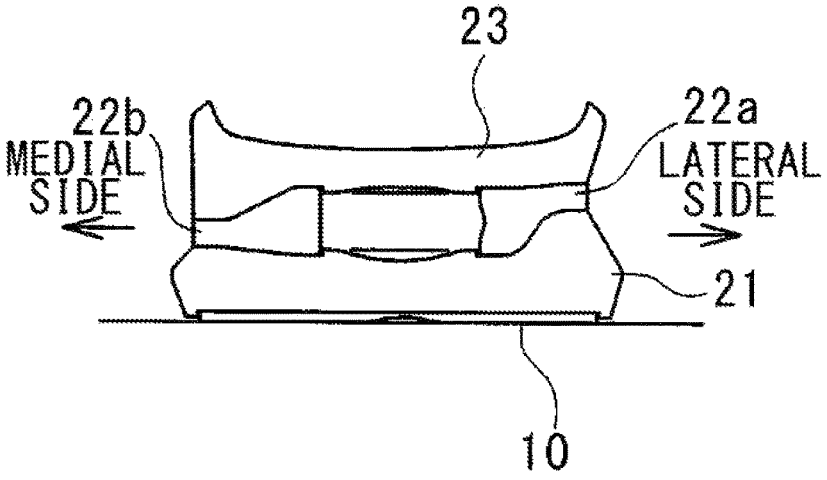
Figure 4D:
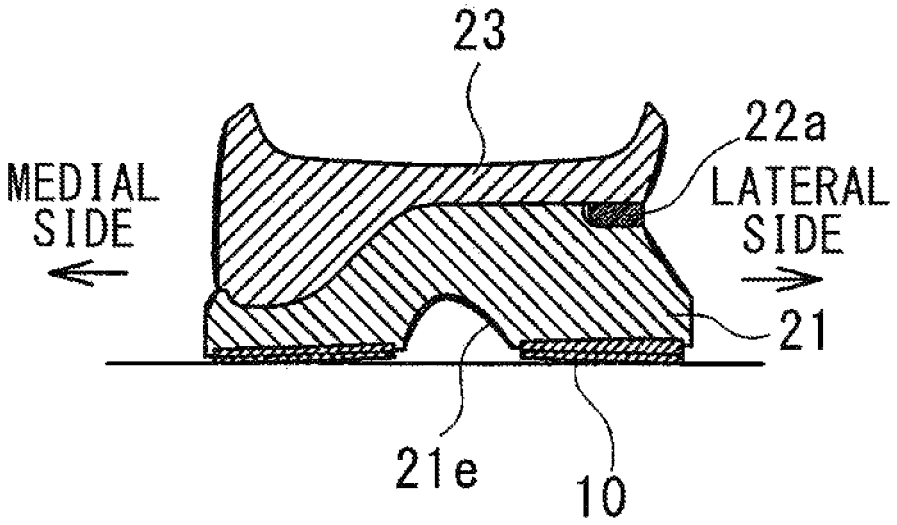

The cushion member 22 of a plate shape is disposed in a heel portion and includes a lateral cushion part 22*a* and a medial cushion part 22*b*. The hardness of the cushion member 22 is lower than that of the lower midsole 21 and the upper midsole 23. The lateral cushion part 22*a* is provided on the lateral side to extend from a rear part of the heel portion to the midfoot portion. The medial cushion part 22*b* is provided in the heel portion to extend from a rear part toward the medial side. The medial cushion part 22*b* has a smaller length dimension than the lateral cushion part 22*a* to restrain medial tilting of the heel. However, the medial cushion part 22*b* may have a length dimension similar to that of the lateral cushion part 22*a* and may be provided to extend toward the lateral side. FIGS. 4A, 4B, 4C and 4D are sectional views of the heel portion, which each intersect a longitudinal direction. FIG. 4A illustrates a cross section of the heel portion of the shoe sole 1 according to the present embodiment, and FIGS. 4B, 4C and 4D illustrate modifications. In the heel portion of the present embodiment illustrated in FIG. 4A, the lateral cushion part 22*a* is shown on the cross section, as described previously. In the modification illustrated in FIG. 4B, the cushion parts are equally provided on the medial side and the lateral side. In the modification illustrated in FIG. 4C, the upper midsole 23 is made thicker on the medial side to restrain medial tilting of the ankle. In the modification illustrated in FIG. 4D, the cushion member 22 is provided only on the lateral side. Also, a groove 21*e*, which corresponds to the groove 21*d* illustrated in FIG. 4A, is provided on the lower surface side of the lower midsole 21 and facilitates the joining between the lower midsole 21 and the upper midsole 23, so that the manufacturing process can be simplified.

The upper midsole 23 includes a rearfoot part 23*a* and a forefoot part 23*b*, which respectively correspond to the rearfoot part 21*a* and the forefoot part 21*b* of the lower midsole 21. The upper midsole 23 is joined such that the bottom surfaces of the rearfoot part 23*a* and the forefoot part 23*b* are laminated on the upper surfaces of the rearfoot part 21*a* and the forefoot part 21*b* of the lower midsole 21. The cushion member 22 is provided in the heel portion between the lower midsole 21 and the upper midsole 23. In the state where the lower midsole 21 and the upper midsole 23 are laminated, the groove 21*d* of the lower midsole 21 penetrates rearward. Toward the front, the groove 21*d* of the lower midsole 21 continues to a through hole penetrating in a vertical direction, which is provided in a region from the midfoot portion to the forefoot portion of the lower midsole 21. The groove 21*d* also continues to a through hole formed in a middle part in a width direction of the outer sole 10.

Figure 5A:
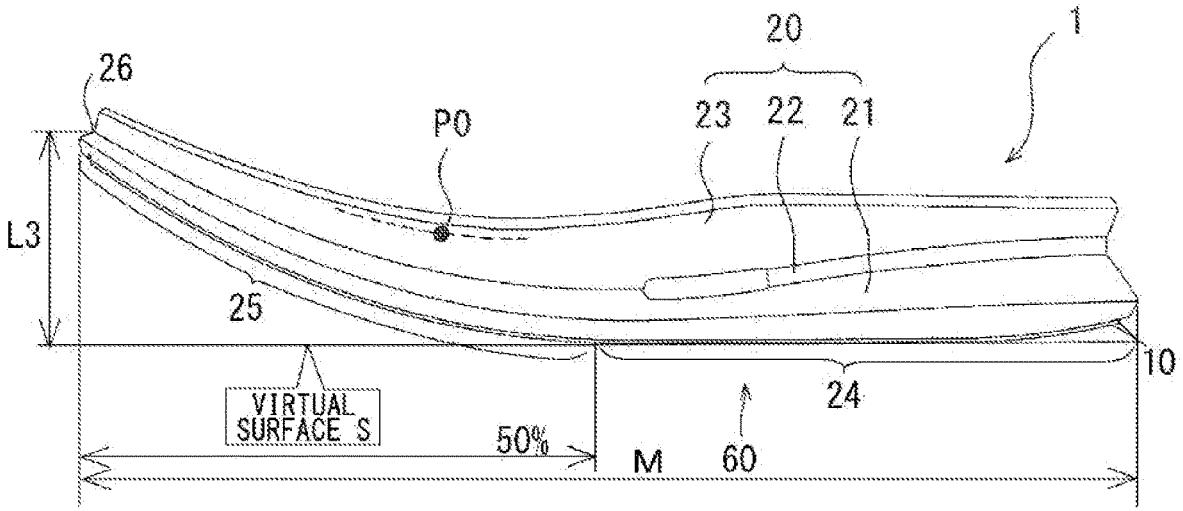
FIG. 5A is a side view that illustrates a lateral side of the shoe sole.
Figure 5B:
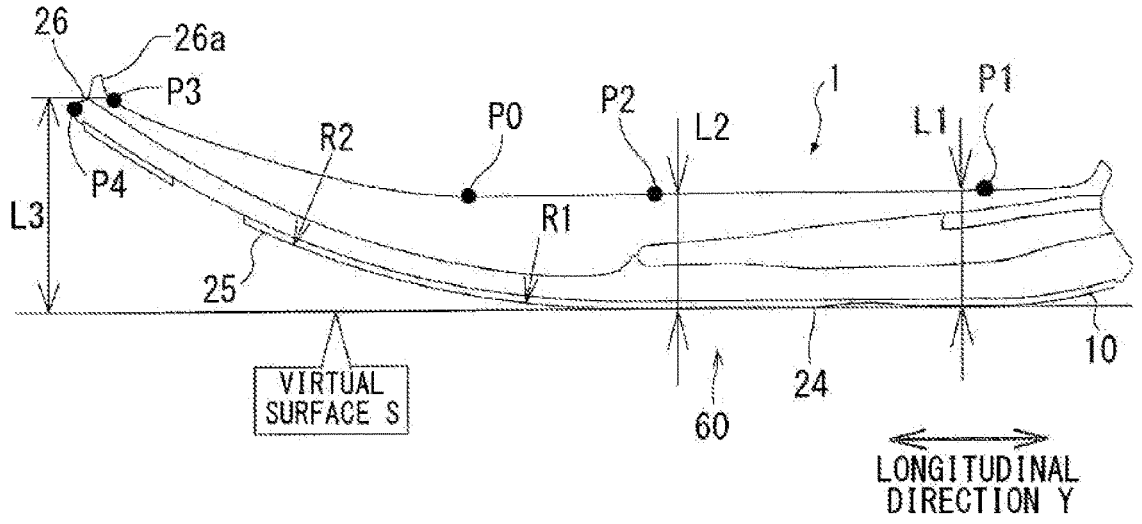
FIG. 5B is a vertical sectional view of the shoe sole, which includes a center line N shown in FIG. 2.

FIG. 5A is a side view that illustrates the lateral side of the shoe sole 1, and FIG. 5B is a vertical sectional view of the shoe sole, which includes the center line N shown in FIG. 2. When the shoe sole 1 is placed on a flat virtual surface S, such as a ground surface, a rear bottom surface part 24 extending from the midfoot portion to the rearfoot portion is in contact with the virtual surface S. The rear bottom surface part 24 may be in contact with the virtual surface S entirely in a longitudinal direction, or may be partially spaced away from the virtual surface S, such as in a rear part of the heel portion. To improve the stability in a region from the heel portion to the midfoot portion at the time of landing, the portion to be in surface-contact of the rear bottom surface part 24 in the heel portion and the midfoot portion may preferably be provided in a range of 20% or greater of the entire length M of the shoe sole 1, and more preferably be provided in a range of 35% or greater thereof. With regard to the surface-contact, when fine asperities are provided on the rear bottom surface part 24, a surface that passes through the lowermost surfaces of the asperities may be regarded as a virtual rear bottom surface part 24.

A front bottom surface part 25 is provided to continue to the front part of the rear bottom surface part 24 and also extend to a toe portion 26 such as to be spaced away from the virtual surface S. The front bottom surface part 25 extends upward toward the front side and reaches the toe portion 26. The front bottom surface part 25 is formed only by a curved surface and a linear surface and does not include a portion extending downward toward the front side. The boundary between the rear bottom surface part 24 and the front bottom surface part 25 is positioned between the position of 50% of the entire length M of the shoe sole 1 from the front end and a point P0 corresponding to an MP joint (the entire length M is assumed to be identical with the entire length of the shoe 100, and the same applies hereinafter). The rear bottom surface part 24 and the front bottom surface part 25 form a bottom surface part 60. The point P0 corresponding to an MP joint may be a position corresponding to the thenar eminence on the upper surface of the midsole 20, as shown in FIG. 5B, or may be a position corresponding to the hypothenar eminence among the MP joints. In other words, P0 may be positioned within a range from 55% to 75% of the entire length M of the shoe sole 1 from the rear end.

A height L3 of the toe portion 26 is defined as a height from the virtual surface to a point P3 at which an edge portion 26*a*, which is joined with the upper 9 in the upper surface of the midsole 20 (an inner-side surface of the shoe 100), extends upward, as illustrated in FIG. 5B. The height L3 of the toe portion 26 may also be defined as a height from the virtual surface to a point P4, which is the tip of the outer shape of the toe portion 26. In the following description, the height from the virtual surface to the point P3 is used as the height L3 of the toe portion 26.

The thickness of the rear bottom surface part 24 side of the shoe sole 1 is considered based on one of a thickness L1 of the shoe sole 1 at a point P1 in the heel portion and a thickness L2 of the shoe sole 1 at a point P2 in the midfoot portion. The height L3 of the toe portion 26 is set to 170% or greater and 250% or less of the thickness L1 of the shoe sole 1 at the point P1 in the heel portion. The height L3 of the toe portion 26 is also set to 170% or greater and 250% or less of the thickness L2 of the shoe sole 1 at the point P2 in the midfoot portion. The position of the point P2 in the midfoot portion may be defined as a position in the thickest part within a range from about 30% to 40% of the entire length M of the shoe sole 1 from the rear end. When the height L3 of the toe portion 26 is defined as the height at the point P4, the height L3 is set to 150% or greater and 250% or less of the thickness L1 of the shoe sole 1 at the point P2 in the midfoot portion.

The position of the point P1 in the heel portion may be defined as a position in the thickest part in the heel portion (a range from 15% to 30% of the entire length M of the shoe sole 1 from the rear end), and the thickness dimension of the shoe sole 1 at the point P1 may be set to 20 mm or greater, for example. The bending rigidity in an extension direction of the shoe sole 1 corresponding to an MP joint part, obtained by three-point bend testing, may be 20 N/mm or greater, for example. In the three-point bend testing, a 8-centimeter length in a longitudinal direction that crosses the MP joint part is supported at the both ends, a middle part between the both ends is pressed downward to obtain the relationship between the displacement and the load, and the slope of the displacement-load curve in a range of the displacement of 5 to 6 mm is obtained. Also, the difference between the thickness of the shoe sole 1 in the heel portion in an unloaded state where a foot is not placed on the shoe sole 1 and the thickness of the shoe sole 1 at a position corresponding to the MP joint part may be set to 5 mm or less, for example.

Figure 6A:
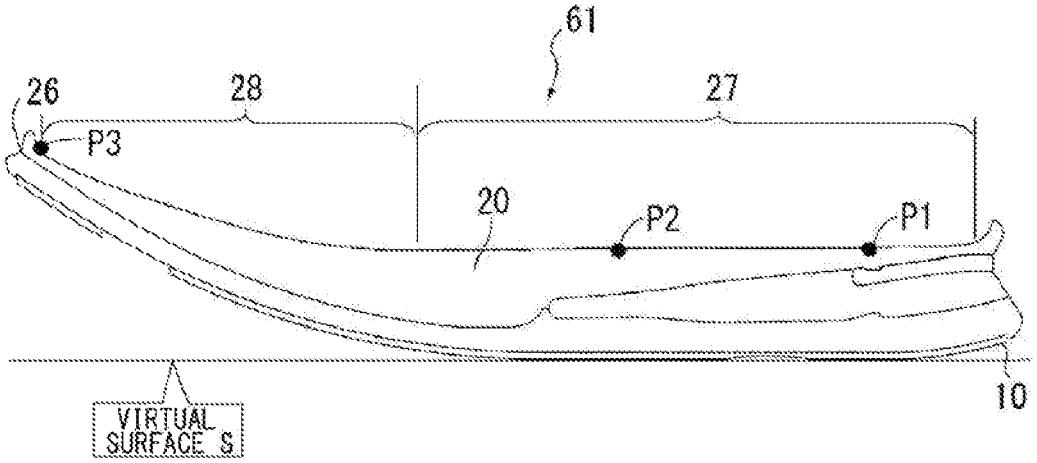
FIGS. 6A and 6B are schematic diagrams used to describe an upper surface of the shoe sole.
Figure 6B:
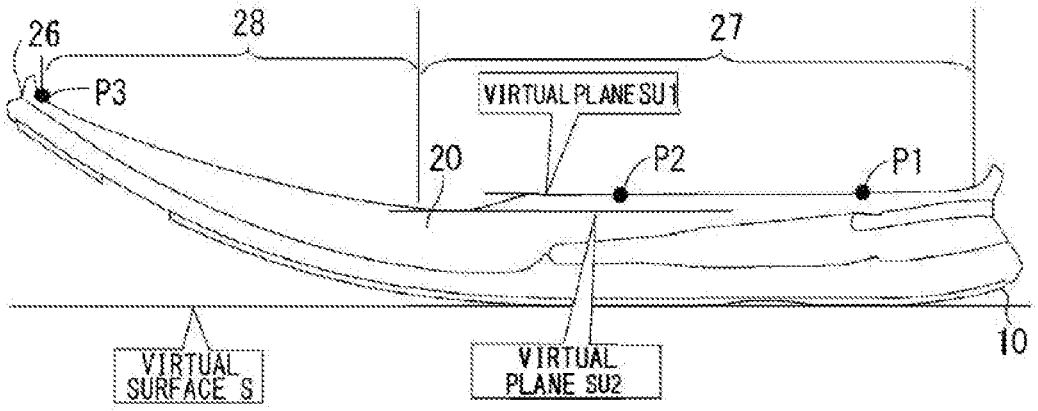
Figure 6B:
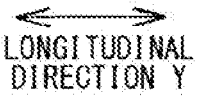

FIGS. 6A and 6B are schematic diagrams used to describe an upper surface part 61 of the shoe sole 1. Each of FIGS. 6A and 6B illustrates a sectional view similar to that in FIG. 5B. A first upper surface part 27 is formed to extend from the rearfoot portion to the midfoot portion and corresponds to a surface included in predetermined parallel conditions with respect to the virtual surface S in an unloaded state. The surface included in predetermined parallel conditions means a surface positioned between a virtual plane SU1 and a virtual plane SU2. The virtual plane SU1 is the highest surface within a region that includes a front end of the first upper surface part 27 (front part), which will be described later, and a position of 15% of the entire length M of the shoe sole 1 from the rear end (rear part), and the virtual plane SU2 is the lowest surface in the region. The surface included in predetermined parallel conditions is also located within a region where the height difference between SU1 and SU2 is 12 mm or less and formed to be parallel with the virtual surface S or to incline downward from the rear part toward the front part. FIG. 6A illustrates the case where the first upper surface part 27 is parallel with the virtual surface S. FIG. 6B illustrates the first upper surface part 27 formed to incline downward from the rear part to the front part with a height reduction amount of 5 mm. For less incongruity on the bottom of a foot, the first upper surface part 27 may be suitably flat with fewer asperities; however, the first upper surface part 27 may have some asperities, have a height difference in a width direction, or have a twist, for example.

A second upper surface part 28 continues to the front end of the first upper surface part 27 and extends upward toward the front side to reach the toe portion 26. The second upper surface part 28 is formed only by a curved surface and a linear surface extending upward toward the front side and does not include a portion extending downward toward the front side. As illustrated in FIGS. 6A and 6B, the second upper surface part 28 is curved to be recessed with respect to the upper side. The boundary (front end) between the first upper surface part 27 and the second upper surface part 28 may be positioned within a range from 25% to 45% of the entire length M of the shoe sole 1 from the front end, for example.

The upper surface of the midsole 20 in the shoe sole 1 has been described with reference to FIGS. 6A and 6B. However, when an inner sole, omitted in the drawings, is provided on the midsole 20, the first upper surface part 27 and the second upper surface part 28 as described above may be defined in the upper surface of the inner sole.

For the outer sole 10, rubber, rubber foam, thermoplastic polyurethane (TPU), and thermoplastic and thermosetting elastomers may be used, for example. In the midsole 20, the lower midsole 21 may be formed of resin foam, for example. As a resin, a polyolefin resin, ethylene-vinyl acetate copolymer (EVA), or a styrene elastomer may be used, for example, and the resin may contain other arbitrary components, such as fiber, as appropriate. For the upper midsole 23, resin foam using a polyolefin resin, EVA, or a styrene elastomer may be used, for example, and the resin foam may contain other arbitrary components, such as cellulose nanofiber or other fiber, as appropriate. The cushion member 22 is formed into a gel state or the like using thermoplastic and thermosetting elastomers, for example. Alternatively, as with the midsole 20, the cushion member 22 may be formed of a foam material such as to be hollow.

The hardness of the outer sole 10 may be set to HA70, for example. Also, in the midsole 20, the hardness of the lower midsole 21 may be set to HC55, the hardness of the upper midsole 23 may be set to HC67, and the hardness of the cushion member 22 may be set to HC47, for example.

Figure 7:
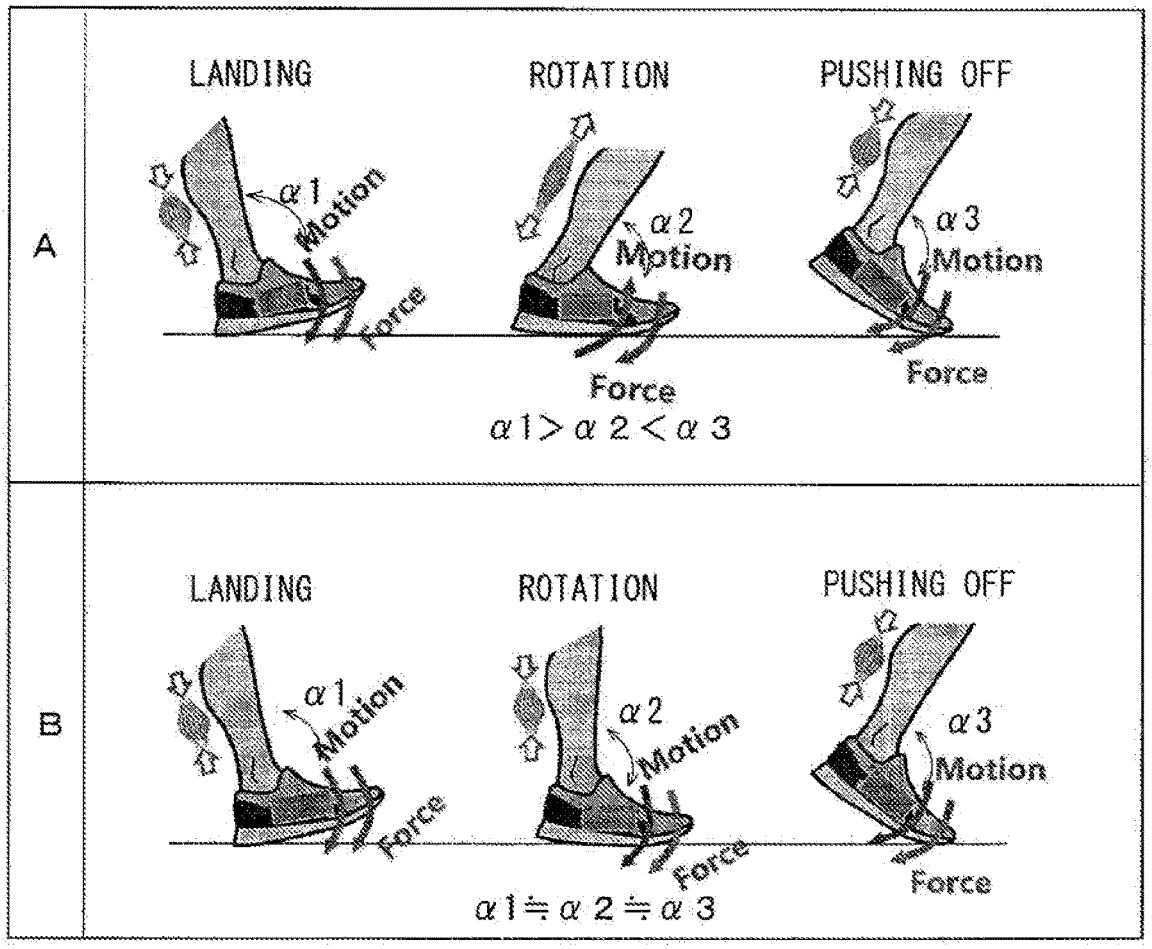
FIG. 7 is a chart used to describe rotational motion of the ankle joint in a longitudinal direction.

There will now be described the functions of the shoe 100. FIG. 7 is a chart used to describe rotational motion of the ankle joint in a longitudinal direction. A column A in FIG. 7 shows a case where the bottom surface of the shoe sole 1 is almost flat, and the rotational motion of the ankle joint in a longitudinal direction is large. In the column A, the body weight is shifted forward after the landing and the ankle joint is bent forward, so that an angle α (α2) at the ankle joint becomes smaller. Such rotational motion of the ankle joint causes stretch motion of muscles of the foot. Thereafter, the angle α (α3) at the ankle joint inversely becomes larger until the pushing off.

Meanwhile, a column B in FIG. 7 shows a case where the shoe sole 1 includes the front bottom surface part 25 described above, and the rotational motion of the ankle joint in a longitudinal direction is small. In the column B, when the body weight is shifted forward after the landing, the shoe sole 1 is rotated such that the front bottom surface part 25 comes into contact with a road surface. Accordingly, the forward rotational motion is restrained, so that the change of the angle α (α2) at the ankle joint is small. Thereafter, the change of the angle α (α3) at the ankle joint remains small until the pushing off.

Figure 8:
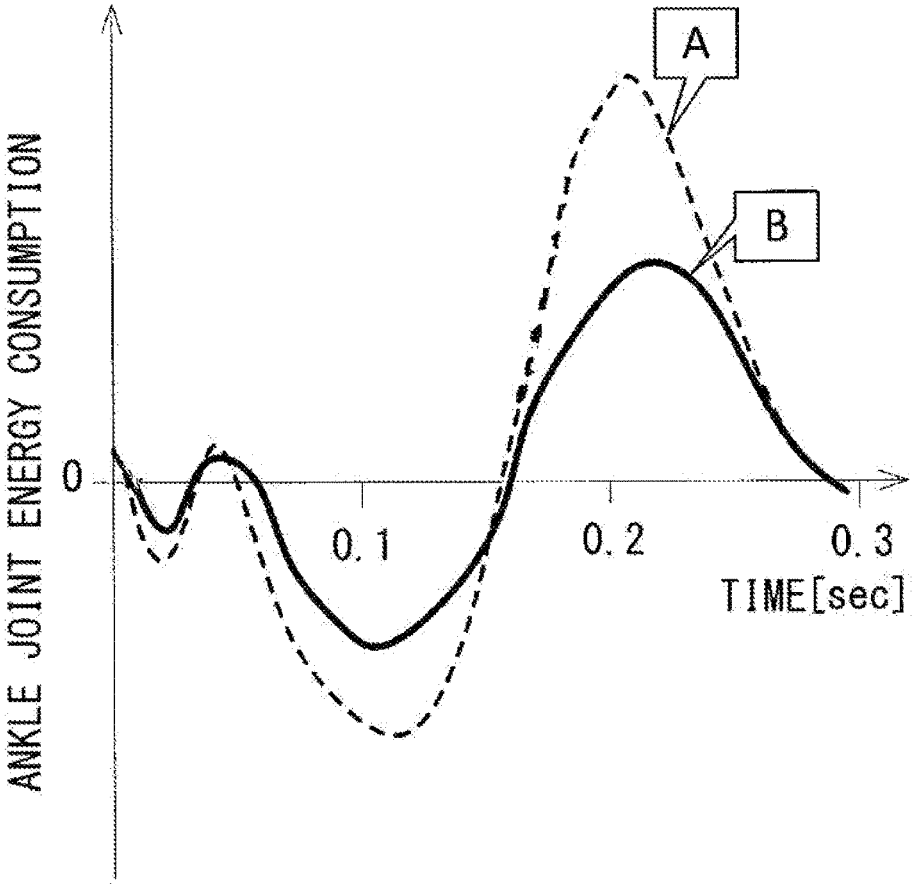
FIG. 8 is a graph as an example that shows energy consumption in the ankle joint.

FIG. 8 is a graph as an example that shows energy consumption in the ankle joint. In FIG. 8, the horizontal axis represents time, and the vertical axis represents energy consumption in the ankle joint, and the energy consumption is compared between the cases of the columns A and B in FIG. 7. Although energy consumption is generally a positive value, the case where muscles contract is indicated in the positive direction, and the case where muscles stretch is indicated in the negative direction, for the sake of convenience.

The energy consumption at the time of landing is greater in the case of the shoe sole 1 in the column A, compared to the case of the shoe sole 1 in the column B. The energy consumption at the time of landing is reduced mainly by the cushion member 22 provided in the heel portion of the shoe sole 1. Until the pushing off after the landing, the rotational motion of the ankle joint a can be made smaller in the case of the column B compared to the case of the column A, as described with reference to FIG. 7. Accordingly, the energy consumption becomes smaller in the case of the column B.

With the rear bottom surface part 24 provided, the stability at the time of landing of a foot can be ensured in the shoe sole 1 of the shoe 100. Also, since the toe portion 26 is positioned higher than the rear bottom surface part 24, the rotational motion of the ankle joint in a longitudinal direction during walking and running is reduced and the energy consumption is restrained, so that strain on the foot can be reduced. With reference to FIG. 5B, by setting the height L3 of the toe portion 26 from the virtual surface S to 170% or greater with respect to the thickness dimension L1 of the rear bottom surface part 24 in the heel portion, the effect of reducing the energy consumption can be achieved. Also, by setting the height L3 of the toe portion 26 from the virtual surface S to 250% or less with respect to the thickness dimension L1 in the heel portion, the bending angle at the MP joint part of the foot can be maintained within a certain range.

By setting the height L3 of the toe portion 26 from the virtual surface S based on the thickness dimension L1 in the heel portion, after the landing of the heel portion, the strain on the ankle joint placed during the rotational motion of the shoe sole 1 toward the toe portion can be reduced. Also, the height L3 of the toe portion 26 from the virtual surface S may be set to 170% or greater and 250% or less with respect to the thickness dimension L2 in the midfoot portion. In this case, it is considered that, at least after the landing of the midfoot portion, the strain on the ankle joint placed during the rotational motion toward the toe portion 26 in the shoe sole 1 can be reduced.

With reference to FIGS. 6A and 6B, the first upper surface part 27 is formed as a surface included in predetermined parallel conditions, as described previously. The second upper surface part 28 is formed to continue to the front end of the first upper surface part 27 and extend upward toward the front side. By maintaining the downward inclination of the first upper surface part 27 toward the front side within a certain range, the upward inclination of the second upper surface part 28 toward the front side can be made gentle. Making the upward inclination of the second upper surface part 28 toward the front side gentle can restrain increase of the upward bending angle at the MP joint part of the foot.

Since the rear bottom surface part 24 includes a portion to be in surface-contact with the virtual surface S in the rearfoot portion and the midfoot portion, the stability at the time of landing of the rear bottom surface part 24 can be increased. Also, since the front bottom surface part 25 continues to the front part of the rear bottom surface part 24 and also curvedly extends to the toe portion 26, the rotational motion of the foot can be smoothly performed. In the front bottom surface part 25, by making a radius of curvature R1 in the rear part continuing to the rear bottom surface part smaller than a radius of curvature R2 in the toe portion, the rotational motion of the shoe sole 1 after the landing of the midfoot portion can be made to function more easily. The radius of curvature R1 smaller than the radius of curvature R2 may be positioned along the MP joint part from the medial side to the lateral side, for example. When R1 is set to 85% or less of R2, the effect of smoother rotational motion can be obtained.

Also, the front bottom surface part 25 includes, within the region thereof, the point P0 facing the MP joint part of a foot. Accordingly, while the rotational motion of the shoe sole 1 proceeds after the landing of the midfoot portion until the landing of the toe portion 26, the motion of the MP joint part of the foot is made smaller. With such smaller motion of the MP joint part of the foot, energy consumption in the MP joint part is reduced, and the strain caused by stretching and contraction in the MP joint part can be reduced.

The upper midsole 23 has higher hardness than the lower midsole 21 and functions as a deformation restraining part for restraining deformation of the shoe sole 1 or the foot, thereby maintaining a constant foot shape more easily. Such a deformation restraining part may be formed to cross at least a portion of each of the rear bottom surface part 24 and the front bottom surface part 25. When the hardness of the upper midsole 23 is set lower, the deformation restraining part may be replaced by a plate member, omitted in the drawings, having relatively high hardness, for example.

The lower midsole 21 has lower hardness than the upper midsole 23 and functions as a deformation allowance part in the shoe sole 1 for absorbing impact at the time of landing or bumps and dips on a road surface. Also, the through hole part 40 provided in the midsole 20 reduces upthrusts from bumps and dips on a road surface in the midfoot portion and functions as a deformation allowance part similarly to the lower midsole 21. Further, the cushion member 22 also reduces impact at the time of landing and upthrusts from bumps and dips on a road surface in the rearfoot portion and functions as a deformation allowance part similarly to the lower midsole 21.

As illustrated in FIG. 5B, a ratio of the thickness dimension of the upper midsole 23 with respect to the thickness dimension of the lower midsole 21 in the forefoot portion and the front part from a middle part in the midfoot portion is larger than that in the rearfoot portion and the rear part of the midfoot portion. Accordingly, in a region from a middle part of the midfoot portion to the toe portion 26 of the shoe sole 1, the effect of restraining the deformation of the shoe sole 1 is higher.

The bending rigidity at the time of bending a material of a plate shape is generally determined based on the Young's modulus and the second moment of area of the material. If the material physical properties, including hardness, are the same and the width is also the same, the bending rigidity is proportional to the cube of the material thickness. Accordingly, when the shoe sole 1 is made thinner, the material physical properties need to be supplemented by insertion of a high-strength member, such as a carbon fiber reinforced plastic, or increase of hardness of the outer sole 10, for example. The outer sole 10 also functions as a deformation restraining part.

When the toe portion 26 of the shoe sole 1 extends upward such that the height of the toe portion 26 is 150% or greater of the thickness dimension L1 of the shoe sole 1 in the heel portion or the thickness dimension L2 of the shoe sole 1 in the midfoot portion (at a position of 30% of the entire length M from the rear end, for example) and when the bending rigidity in a longer axis direction in the forefoot portion of the shoe sole 1 (the rigidity at a position corresponding to the MP joint part) is three or more times larger than the rigidity of general running shoes (3 N/mm as a reference value), the deformation of the shoe sole 1 is restrained, and the effect of reducing the strain at the ankle joint can achieved.

When the height of the toe portion 26 extending upward is low, it is ineffective even though the shoe sole 1 is hard. Since the change of the angle at the ankle joint can be made small and the angular velocity can be reduced while the foot is in contact with the ground during walking and running, the workload of the ankle joint is reduced, and running with less effort can be enabled.

Second Embodiment

Figure 9:
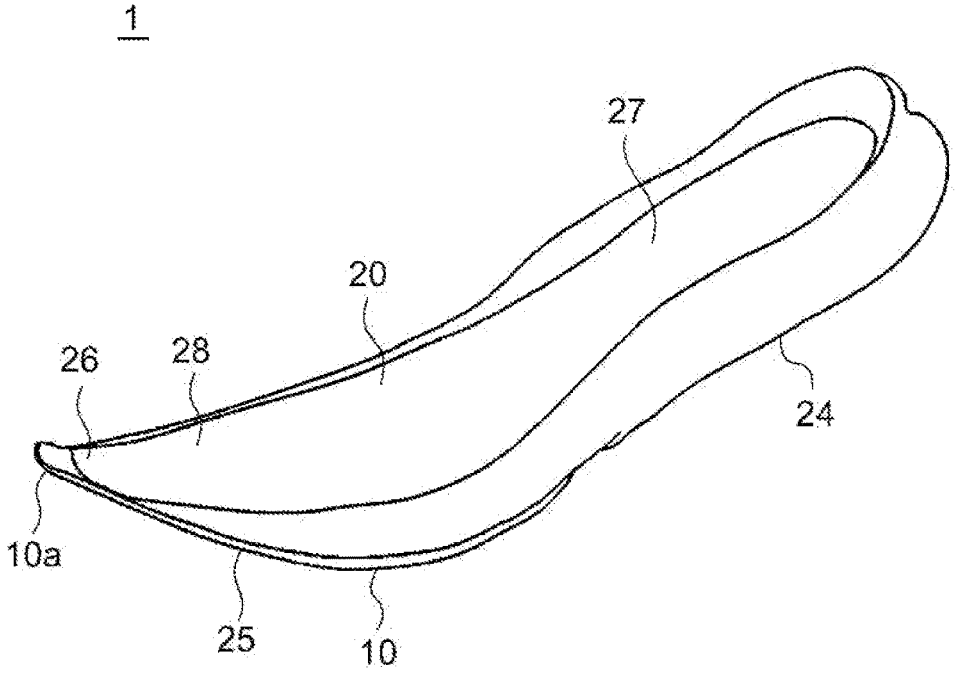
FIG. 9 is a perspective view that illustrates an external view of a shoe sole according to a second embodiment.
Figure 10:
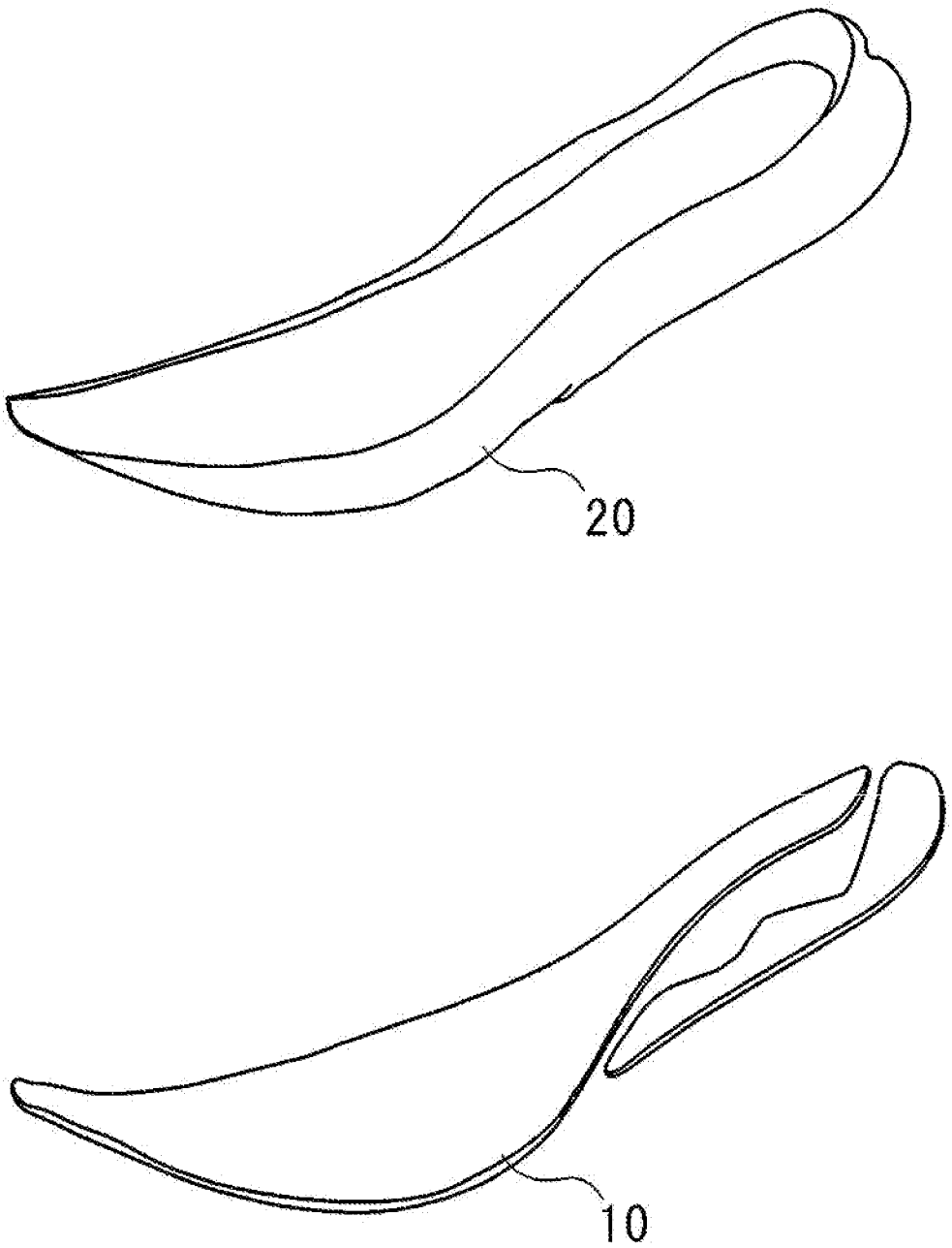
FIG. 10 is an exploded perspective view of the shoe sole.

FIG. 9 is a perspective view that illustrates an external view of a shoe sole 1 according to a second embodiment, and FIG. 10 is an exploded perspective view of the shoe sole 1. To the shoe sole 1, the upper 9 as illustrated in FIG. 1 is joined such as to configure a shoe. As is the case in the first embodiment, the shoe sole 1 according to the second embodiment also includes the outer sole 10 and the midsole 20. The midsole 20 is not divided between the lower midsole and the upper midsole and is integrally formed. A tip part 10*a* of the toe portion 26 of the outer sole 10 is curled up along the upper 9.

The material, shape, and the like of the midsole 20 of the shoe sole 1 may be determined so that, while the shoe sole 1 has cushioning properties, the bending rigidity of the shoe sole 1 is ensured, for example. The midsole 20 may be set between the hardness of the lower midsole 21 (HC55) and the hardness of the upper midsole 23 (HC67) described in the first embodiment, for example.

The relationships among the thickness dimension L1 in the heel portion, the thickness dimension L2 in the midfoot portion, and the height L3 in the toe portion 26 from the virtual surface S in the shoe sole 1 according to the second embodiment are identical with those described in the first embodiment based on FIGS. 5A and 5B. The rear bottom surface part 24, the front bottom surface part 25, the first upper surface part 27, the second upper surface part 28, and the like are also identical with those described in the first embodiment based on FIGS. 6A and 6B.

The toe portion 26 in the shoe sole 1 is provided at a high position, so that the rotational motion of the ankle joint is restrained and the energy consumption is reduced, thereby reducing the strain at the foot, as is the case in the first embodiment. Also, the rear bottom surface part 24, the front bottom surface part 25, the first upper surface part 27, the second upper surface part 28, and the like function similarly to those in the first embodiment.

If the hardness of the midsole 20 of the shoe sole 1 is set lower, impact at the time of landing and upthrusts from bumps and dips on a road surface can be reduced, but the restraint on the rotational motion of the ankle joint will be limitative because of allowed bending deformation. Accordingly, such a shoe sole is better suited for sports that apply relatively small loads to shoes, such as walking and running as light exercise.

If the hardness of the midsole 20 of the shoe sole 1 is set higher, bending deformation of the shoe sole 1 will be reduced and the rotational motion of the ankle joint will be restrained, so that the strain on the foot can be reduced. However, impact at the time of landing and upthrusts from bumps and dips on a road surface will be allowed. In this case, to prevent the impact at the time of landing and upthrusts from bumps and dips on a road surface, a cushion material or the like may be provided as appropriate.

Third Embodiment

Figure 11A:
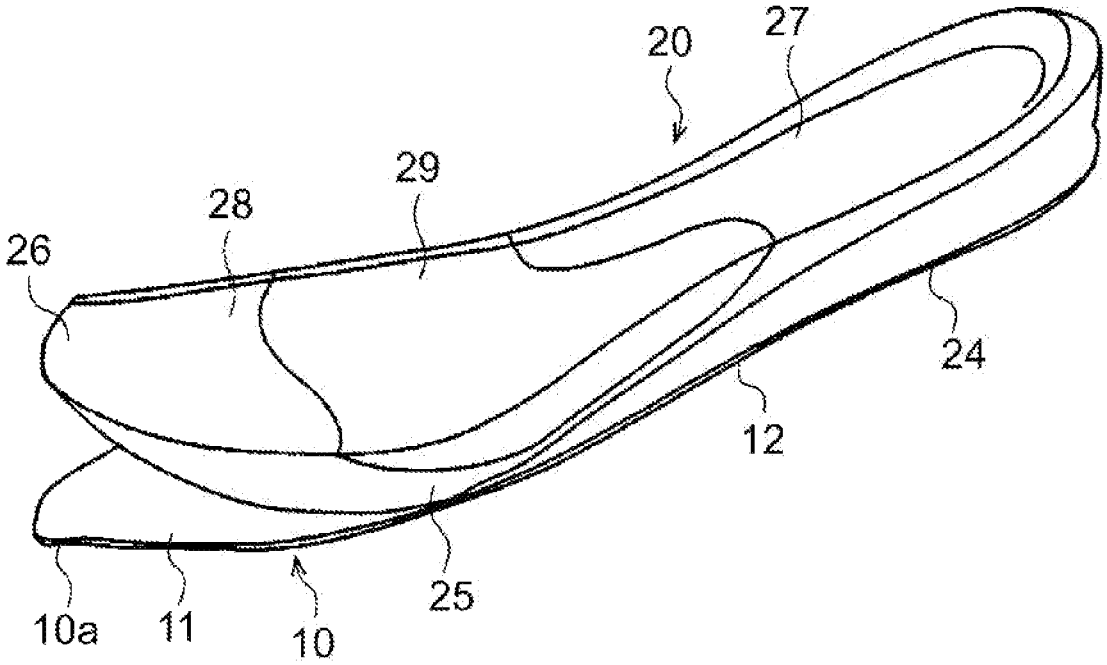
FIG. 11A is a perspective view that illustrates an external view of a shoe sole according to a third embodiment viewed from the lateral side.
Figure 11B:
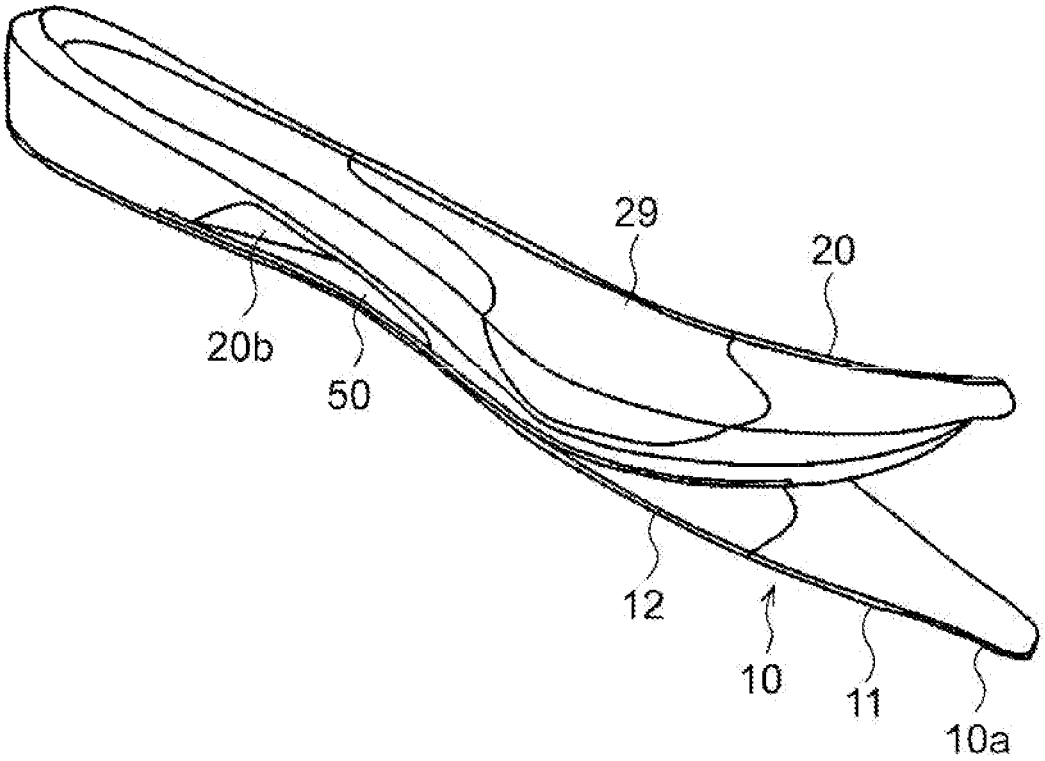
FIG. 11B is a perspective view that illustrates an external view of the shoe sole according to the third embodiment viewed from the medial side.
Figure 12:
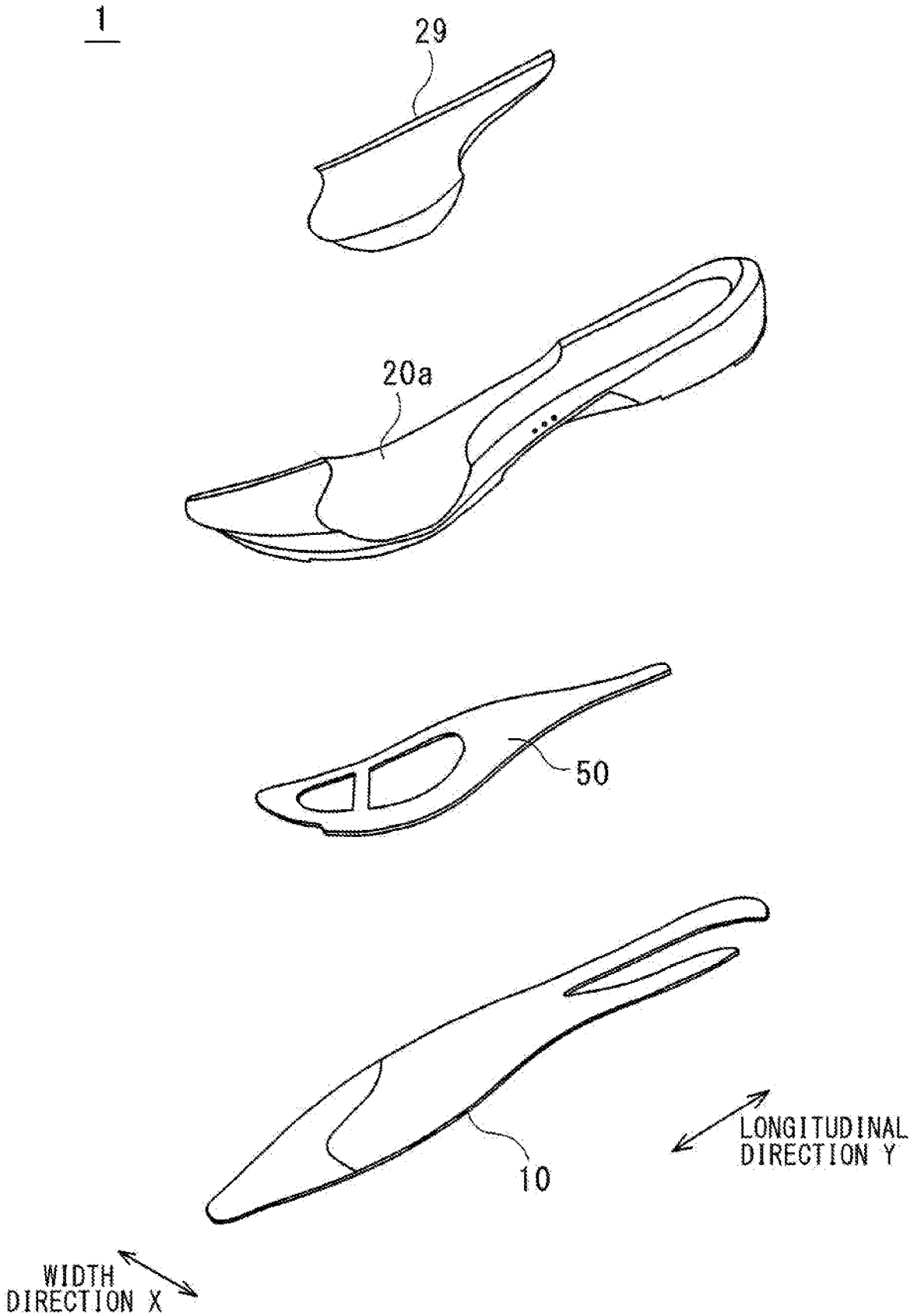
FIG. 12 is an exploded perspective view of the shoe sole.

FIG. 11A is a perspective view that illustrates an external view of a shoe sole 1 according to a third embodiment viewed from the lateral side, and FIG. 11B is a perspective view that illustrates an external view of the shoe sole 1 according to the third embodiment viewed from the medial side. FIG. 12 is an exploded perspective view of the shoe sole 1. To the shoe sole 1, the upper 9 as illustrated in FIG. 1 is joined such as to configure a shoe. As is the case in the first embodiment, the shoe sole 1 according to the third embodiment also includes the outer sole 10 and the midsole 20, and a plate member 50 is further provided between the outer sole 10 and the midsole 20. The outer sole 10 includes a toe sole part 11 disposed in a toe part, and a sole main body 12 that continues to the rear part of the toe sole part 11. The tip part 10*a* of the toe portion 26 of the outer sole 10 is curled up along the upper 9.

In a region from the forefoot portion to the midfoot portion of the midsole 20, a recess 20*a* (see FIG. 12) is formed such as to hole the upper surface. Into the recess 20*a*, a cushion member 29 having a shape corresponding to the recess 20*a* is fitted. The cushion member 29 extends along the entire width in a width direction X to correspond to the MP joints Ja of a foot and also extends rearward on the lateral side. Alternatively, the shoe sole 1 may be configured not to include the recess 20*a* and the cushion member 29, and a portion corresponding to the cushion member 29 may be made of the same material as the midsole 20 and integrally formed.

Figure 13:
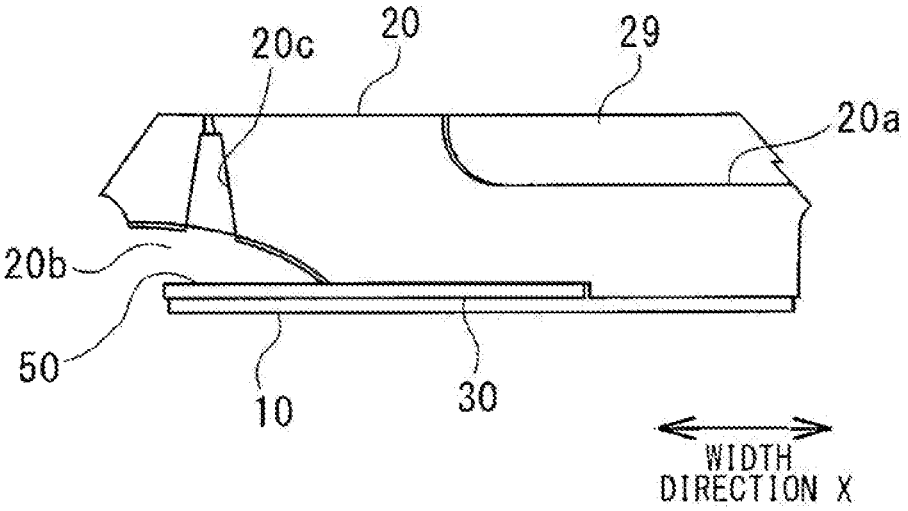
FIG. 13 is a sectional view, intersecting a longitudinal direction, of the shoe sole including a cutout part.

On the medial side of the midfoot portion of the midsole 20, a cutout part 20*b* is formed. The cutout part 20*b* is formed such as to hole the medial side of the midfoot portion and is open on the medial side and the bottom side. FIG. 13 is a sectional view, intersecting a longitudinal direction, of the shoe sole 1 including the cutout part 20*b*. The bottom side of the cutout part 20*b* is closed by the plate member 50 disposed along the lower surface of the midsole 20. The inner side of the cutout part 20*b* is closed at a middle part in a width direction X. Also, a vent hole 20*c* is formed to pierce through the midsole 20 from the upper inner surface of the cutout part 20*b* toward the upper side, thereby allowing air to pass through the inside of the shoe easily.

The plate member 50 is formed of a material having higher rigidity than the other portions of the shoe sole. Also, the plate member 50 has a thin plate shape of which the outer dimension in a width direction X is larger in the midfoot portion and extends to be narrower toward the forefoot portion and the rearfoot portion. The plate member 50 illustrated in FIG. 12 has a shape that includes through holes vertically piercing in the midfoot portion; however, the plate member 50 may have a shape that does not include the through holes.

For the toe sole part 11 of the outer sole 10, rubber, rubber foam, and thermoplastic and thermosetting elastomers may be used, for example. For the sole main body 12, rubber, rubber foam, and thermoplastic and thermosetting elastomers may be used, for example, and a thermoplastic resin, such as thermoplastic polyurethane (TPU), may also be included. The midsole 20 may be formed of resin foam, for example. As a resin, a thermoplastic resin, such as a polyolefin resin and ethylene-vinyl acetate copolymer (EVA), may be used, for example, and the resin may contain other arbitrary components, such as fiber, as appropriate. The cushion member 29 may be formed of resin foam, for example. For the cushion member 29, a foamed body using a polyolefin resin, EVA, or a styrene elastomer may be used, for example. For the plate member 50, a glass fiber reinforced plastic or other fiber reinforced plastics may be used, and thermoplastic and thermosetting elastomers may also be used.

In the outer sole 10, the hardness of the toe sole part 11 may be set to HA62, and the hardness of the sole main body 12 may be set to HA70, for example. Also, the hardness of the midsole 20 may be set to HC57, and the hardness of the cushion member 29 may be set to HC50, for example. For the plate member 50, high rigidity is ensured by setting the elastic modulus to 2.87 GPa, for example, and the hardness of the plate member 50 is set higher than that of the midsole 20.

The relationships among the thickness dimension L1 in the heel portion, the thickness dimension L2 in the midfoot portion, and the height L3 in the toe portion 26 from the virtual surface S in the shoe sole 1 according to the third embodiment are identical with those described in the first embodiment based on FIGS. 5A and 5B. The rear bottom surface part 24, the front bottom surface part 25, the first upper surface part 27, the second upper surface part 28, and the like are also identical with those described in the first embodiment based on FIGS. 6A and 6B.

The toe portion 26 in the shoe sole 1 is provided at a high position, so that the rotational motion of the ankle joint is restrained and the energy consumption is reduced, thereby reducing the strain at the foot, as is the case in the first embodiment. Also, the rear bottom surface part 24, the front bottom surface part 25, the first upper surface part 27, the second upper surface part 28, and the like function similarly to those in the first embodiment.

The hardness of the midsole 20 may be set to HC57 as described above, for example, which is similar to the hardness of the lower midsole 21 in the first embodiment (HC55). Accordingly, the bending rigidity of the midsole 20 becomes lower. The plate member 50 provided between the midsole 20 and the outer sole 10 supplements the bending rigidity of the midsole 20 and functions as a deformation restraining part for restraining deformation of the shoe sole 1. With the plate member 50 provided, the bending deformation of the shoe sole 1 is reduced and the rotational motion of the ankle joint is restrained, so that the strain on the foot can be reduced.

In the shoe sole 1, the hardness of the midsole 20 is set to a value similar to the hardness of the lower midsole 21 in the first embodiment, thereby restraining impact at the time of landing and upthrusts from bumps and dips on a road surface. Providing the cushion member 29 in the shoe sole 1 also restrains impact at the time of landing and upthrusts from bumps and dips on a road surface.

The cutout part 20*b* provided in the midsole 20 reduces lowering of the medial longitudinal arch of a foot. When a person tightens a shoelace or the like to wear a shoe, lowering of the medial longitudinal arch of the foot sometimes occurs. By providing the cutout part 20*b* on the medial side of the midfoot portion of the midsole 20, when a person wears the shoe, the midsole 20 is deformed such as to lift up on the medial side of the midfoot portion, so that lowering of the medial longitudinal arch of the foot can be reduced.

The vent hole 20*c* is provided to pierce through the midsole 20 from the upper inner surface of the cutout part 20*b* toward the upper side, thereby restraining entry of water into the shoe. Also, since the vent hole 20*c* is provided in a middle part in a width direction of the cutout part 20*b*, a space of the cutout part 20*b* is located below the vent hole 20*c*. Accordingly, water entering the vent hole 20*c* drops into the space, so that entry of water into the shoe can be restrained.

Modification

Figure 14:
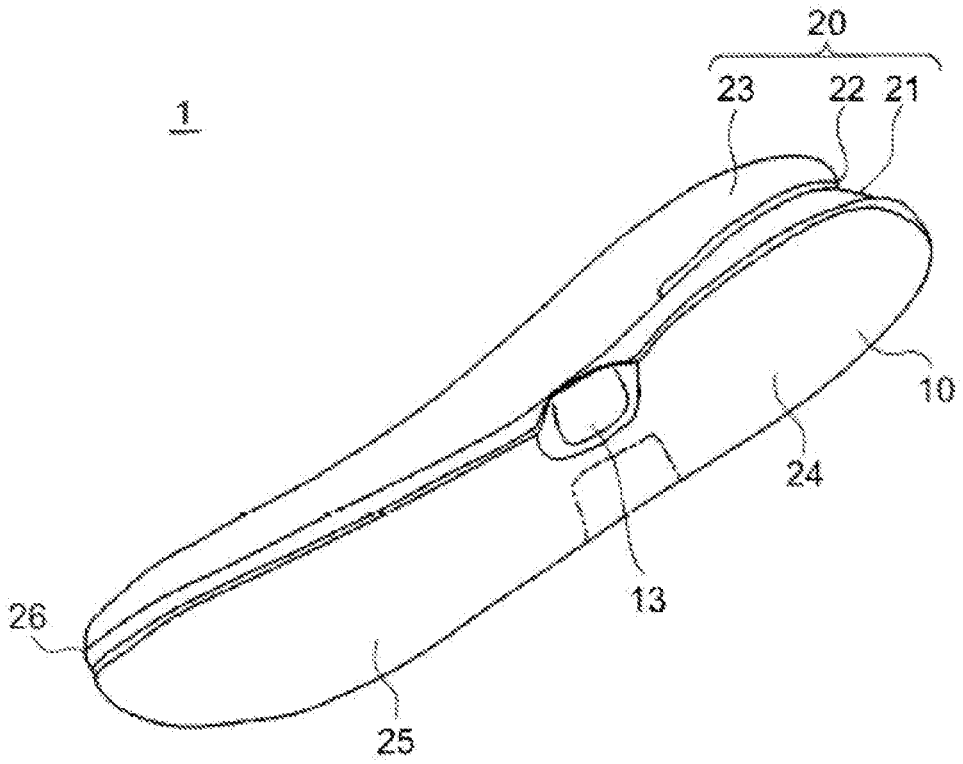
FIG. 14 is a perspective view that illustrates an external view of a shoe sole according to a modification viewed from a bottom portion side.

FIG. 14 is a perspective view that illustrates an external view of a shoe sole 1 according to a modification viewed from a bottom portion side. In the modification illustrated in FIG. 14, the recess 13 is formed on the lateral side of the midfoot portion of the rear bottom surface part 24 such as to hole the bottom surface toward the upper side. The recess 13 restrains upthrusts from bumps and dips on a road surface in the midfoot portion. The recess 13 need not necessarily be provided on the bottom surface of the shoe sole 1.

In the example illustrated in FIG. 14, the recess 13 is provided on the lateral side of the midfoot portion; however, the recess 13 may be provided on the medial side of the midfoot portion, as indicated by a dashed dotted line, or may be provided on each of the lateral side and the medial side. Also, the recess 13 may be provided along the entire width from the medial side to the lateral side in the midfoot portion. When the recess 13 is provided, the height from the virtual surface S to the upper surface of the midsole 20 may be used as a substitute for the thickness dimension L2 of the shoe sole 1 in the midfoot portion described with reference to FIG. 5B.

There will now be described the features of the shoe sole 1 and the shoe 100 according to the embodiments and the modification.

The shoe sole 1 includes the rear bottom surface part 24 and the toe portion 26. The rear bottom surface part 24 is formed to extend from the rearfoot portion to the midfoot portion and, when the shoe sole is placed on a flat virtual surface S, the rear bottom surface part 24 is in contact with the virtual surface S. The height L3 of the toe portion 26 from the virtual surface S is set to 170% or greater and 250% or less with respect to a thickness dimension in the rear bottom surface part 24. Accordingly, the shoe sole 1 can ensure stability of landing of the rear bottom surface part 24 and also reduce the strain on the ankle joint during forward walking and running.

The shoe sole 1 also includes the first upper surface part 27 and the second upper surface part 28. The first upper surface part 27 is formed to extend from the rearfoot portion to the midfoot portion and is formed as a surface included in predetermined parallel conditions, as described previously. The second upper surface part 28 continues to the front end of the first upper surface part 27 and extends upward toward the front side to reach the toe portion 26. Accordingly, in the shoe sole 1, since the downward inclination of the first upper surface part 27 toward the front side is maintained within a certain range, the upward inclination of the second upper surface part 28 toward the front side can be made gentle, so that excessive upward bending of the toe can be restrained.

As a thickness dimension of the shoe sole 1, a dimension in the heel portion (the thickness dimension L1) is used. Accordingly, in the shoe sole 1, the height L3 of the toe portion 26 from the virtual surface S is set based on the thickness of the heel portion, so that, after the landing of the heel portion, the strain on the ankle joint placed during the rotational motion toward the toe portion can be reduced.

As a thickness dimension of the shoe sole 1, a dimension in the midfoot portion (the thickness dimension L2) is also used. Accordingly, in the shoe sole 1, the height L3 of the toe portion 26 from the virtual surface S is set based on the thickness of the midfoot portion, so that, at least after the landing of the midfoot portion, the energy generated at the ankle joint placed during the rotational motion toward the toe portion can be reduced.

The rear bottom surface part 24 includes a portion to be in surface-contact with the virtual surface S, in a range of 20% or greater of the entire shoe sole in the rearfoot portion and the midfoot portion. This increases stability at the time of landing of the rear bottom surface part 24 in the shoe sole 1.

The shoe sole 1 also includes the front bottom surface part 25 that continues to the front part of the rear bottom surface part 24 and also curvedly extends to the toe portion 26 such as to be spaced away from the virtual surface. This can make the rotational motion of a foot smoother in the shoe sole 1.

In the front bottom surface part 25, the radius of curvature R1 in the rear part continuing to the rear bottom surface part 24 is smaller than the radius of curvature R2 in a middle part continuing to the rear part. Accordingly, in the shoe sole 1, the rotational motion of the shoe sole 1 after the landing of the midfoot portion can be made to function more easily.

The front bottom surface part 25 includes a portion (point P0) facing the MP joint part of a foot. Accordingly, in the shoe sole 1, while the rotational motion of the shoe sole 1 proceeds until the landing of the toe portion 26, the motion of the MP joint part of the foot is made smaller.

The shoe sole 1 also includes the upper midsole 23 as a deformation restraining part formed to cross at least a portion of each of the rear bottom surface part 24 and the front bottom surface part 25. Accordingly, with the shoe sole 1, a constant foot shape can be maintained more easily.

The shoe sole 1 also includes the lower midsole 21 as a deformation allowance part formed beneath the upper midsole 23. Accordingly, in the shoe sole 1, impact at the time of landing and a change in a road surface can be absorbed in the deformation allowance part.

The lower midsole 21 as the deformation allowance part extends from the rearfoot portion to the toe portion 26, and has lower hardness than the upper midsole 23 as the deformation restraining part. This makes the shoe sole 1 to have cushioning properties in the region from the rearfoot portion to the toe.

The deformation allowance part may include the through hole part 40 that is provided in the midfoot portion and that penetrates in a width direction. Accordingly, in the shoe sole 1, upthrusts from bumps and dips on a road surface in the midfoot portion can be restrained.

The deformation allowance part may also include the cushion member 22 disposed in the rearfoot portion. This makes the shoe sole 1 to have cushioning properties in the rearfoot portion.

The deformation restraining part may be constituted by the plate member 50. Accordingly, in the shoe sole 1, while a constant foot shape is maintained by means of the plate member 50, the other midsole portions can be made to have cushioning properties.

The shoe 100 includes the shoe sole 1 as described above, and the upper 9 disposed on the shoe sole 1. Accordingly, the shoe 100 can ensure stability of landing of the rear bottom surface part 24 and also reduce the energy generated at the ankle joint during forward walking and running.

The present invention has been described with reference to embodiments. The embodiments are intended to be illustrative only, and it will be obvious to those skilled in the art that various modifications and changes could be developed within the scope of claims of the present invention and that such modifications and changes also fall within the scope of claims of the present invention. Therefore, the description in the present specification and the drawings should be regarded as exemplary rather than limitative.

DESCRIPTION OF THE REFERENCE NUMERALS

1 shoe sole, 21 lower midsole (deformation allowance part), 22 cushion member, 23 upper midsole (deformation restraining part), 24 rear bottom surface part, 25 front bottom surface part, 26 toe portion, 27 first upper surface part, 28 second upper surface part, 40 through hole part (deformation allowance part), 50 plate member (deformation restraining part), 60 bottom surface part, 61 upper surface part, 9 upper, 100 shoe

INDUSTRIAL APPLICABILITY

The present invention relates to a shoe.

The invention claimed is:

1. A shoe sole comprising:

a rearfoot portion, a midfoot portion, and a toe portion, and a rear bottom surface part formed from the rearfoot portion to the midfoot portion, wherein when the shoe sole is placed on a virtual flat surface, (1) the rear bottom surface part is in contact with the virtual flat surface, (2) the toe portion is in non-contact with the virtual flat surface, and (3) a distance from the virtual flat surface to the toe portion is equal to 170% or greater and 250% or less of a thickness of the shoe sole corresponding to the rear bottom surface part, wherein the distance from the virtual flat surface to the toe portion is a height of a tip of the toe portion from the virtual flat surface, the tip of the toe portion is closest to the virtual flat surface in the toe portion when the shoe sole is placed on the virtual flat surface, and wherein the shoe sole has bending rigidity of 20 N/mm or grater in a direction from the rearfoot portion to the toe portion.

2. The shoe sole according to claim 1, further comprising:

a first upper surface part formed from the rearfoot portion to the midfoot portion and included in a predetermined parallel condition; and a second upper surface part that upwardly extends to the toe portion from a front end of the first upper surface part.

3. The shoe sole according to claim 1, wherein the thickness is a thickness of a heel portion.

4. The shoe sole according to claim 1, wherein the thickness is a thickness of the midfoot portion.

5. The shoe sole according to claim 1, wherein the rear bottom surface part comprises a contact area that is in surface-contact with the virtual flat surface, and the contact area is equal to 20% or greater of an entire surface of the shoe sole.

6. The shoe sole according to claim 1, further comprising a front bottom surface part that extends from a front part of the rear bottom surface part and also curvedly and upwardly extends to the toe portion so that the front bottom surface part is gradually away from the virtual flat surface toward the toe portion, wherein the front bottom surface part includes a portion adapted to face a metatarsophalangeal point (MP) joint part of a foot.

7. The shoe sole according to claim 6, wherein a radius of curvature in a rear part of the front bottom surface part continuing to the rear bottom surface part is smaller than a radius of curvature in the toe portion.

8. The shoe sole according to claim 6, further comprising a deformation restraining part formed at least from a portion of the rear bottom surface part to a portion of the front bottom surface part.

9. A shoe comprising:

the shoe sole according to claim 1; and an upper disposed on the shoe sole.

10. A shoe sole comprising:

a rearfoot portion, a midfoot portion, and a toe portion;

a bottom surface part that includes a rear bottom surface part formed from the rearfoot portion to the midfoot portion, wherein when the shoe sole is placed on a virtual flat surface, (1) the rear bottom surface part is in contact with the virtual flat surface and (2) the toe portion is in non-contact with the virtual flat surface, and a front bottom surface part that is formed from a front part of the rear bottom surface part and that extends curvedly and upwardly extend to the toe portion so that the front bottom surface part is gradually away from the virtual flat surface;

an upper surface part that includes a first upper surface part formed from the rearfoot portion to the midfoot portion, wherein the first upper surface part includes a surface that is parallel with the virtual flat surface in an unloaded state or a surface that extends downward from a rear part toward a front side with respect to the virtual flat surface in the unloaded state, and a second upper surface part that upwardly extends toward the toe portion from a front end of the first upper surface part; and a deformation restraining part (1) that is formed at least from a portion of the rear bottom surface part and a portion of the front bottom surface part, and (2) that includes a region adapted to face an MP joint part of a foot, wherein, in the upper surface part, the front end of the first upper surface part is closest to the virtual flat surface, and a front end of the second upper surface part is most distant from the virtual flat surface, and wherein the shoe sole has bending rigidity of 20 N/mm or grater in a direction from the rearfoot portion to the toe portion.

11. The shoe sole according to claim 10, further comprising a deformation allowance part formed beneath the deformation restraining part.

12. The shoe sole according to claim 11, wherein the deformation allowance part extends from the rearfoot portion to the toe portion, and the deformation allowance part comprises a member having lower hardness than the deformation restraining part.

13. The shoe sole according to claim 11, wherein the deformation allowance part comprises a through hole that is provided in the midfoot portion and that penetrates the midfoot portion in a width direction of the shoe sole.

14. The shoe sole according to claim 11, wherein the deformation allowance part comprises a cushion member disposed in the rearfoot portion.

15. The shoe sole according to claim 10, wherein the deformation restraining part comprises a plate member.

16. A shoe comprising:

the shoe sole according to claim 10; and an upper disposed on the shoe sole.

* * * * *